US006540314B1

(12) United States Patent
Sanada et al.

(10) Patent No.: US 6,540,314 B1
(45) Date of Patent: Apr. 1, 2003

(54) INK TANK, CARTRIDGE INCLUDING THE INK TANK, AND PRINTING APPARATUS USING THE CARTRIDGE

(75) Inventors: Mikio Sanada, Yokohama (JP); Yoshifumi Hattori, Yamato (JP); Masanori Takenouchi, Yokohama (JP); Osamu Morita, Yokosuka (JP); Shinya Mishina, Kawasaki (JP); Hiroshi Koshikawa, Kawasaki (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/425,013

(22) Filed: Oct. 25, 1999

(30) Foreign Application Priority Data

Oct. 27, 1998 (JP) ..... 10-306160
Oct. 1, 1999 (JP) ..... 11-282140

(51) Int. Cl.[7] ..... B41J 2/195
(52) U.S. Cl. ..... 347/7
(58) Field of Search ..... 347/47, 45, 49, 347/65, 86, 50, 70, 158, 30, 2; 204/450

(56) References Cited

U.S. PATENT DOCUMENTS

| | | | | | |
|---|---|---|---|---|---|
| 4,183,030 | A | * | 1/1980 | Kaieda et al. | 347/2 |
| 4,577,203 | A | * | 3/1986 | Kawamura | 347/30 |
| 5,136,310 | A | * | 8/1992 | Drews | 347/45 |
| 5,216,448 | A | | 6/1993 | Unosawa et al. | 347/49 |
| 5,262,802 | A | | 11/1993 | Karita et al. | 347/87 |
| 5,389,957 | A | | 2/1995 | Kimura et al. | 347/20 |
| 5,534,899 | A | * | 7/1996 | Uchikata et al. | 347/49 |
| 5,663,752 | A | * | 9/1997 | Imamura et al. | 347/65 |
| 5,714,992 | A | * | 2/1998 | Desie | 347/158 |
| 5,850,238 | A | | 12/1998 | Karita et al. | 347/29 |
| 5,956,056 | A | | 9/1999 | Kaneko et al. | 347/43 |
| 6,262,833 | B1 | * | 7/2001 | Loxley et al. | 204/450 |
| 6,362,844 | B1 | * | 3/2002 | Shieh et al. | 347/70 |

FOREIGN PATENT DOCUMENTS

| | | |
|---|---|---|
| EP | 0 479 493 A1 | 4/1992 |
| EP | 0 250 248 | 11/1997 |
| EP | 0 860 284 A2 | 8/1998 |
| JP | 63-003029 | 1/1988 |
| JP | 7-89090 | 4/1995 |
| JP | 7-218321 | 8/1995 |
| JP | 7-237300 | 9/1995 |
| JP | 8-112907 | 5/1996 |
| JP | 8-187873 | 7/1996 |
| JP | 8-231726 | 9/1996 |
| JP | 9-29989 | 2/1997 |
| JP | 10-060386 | 3/1998 |
| JP | 10-279915 | 10/1998 |
| JP | 10-310628 | 11/1998 |
| KR | 0000 492 | 3/1988 |
| KR | 1988-492 | 3/1988 |

OTHER PUBLICATIONS

Patent Abstracts of Japan, JP 07 237300 A, vol. 1996, No. 01, (Jan. 31, 1996).

Patent Abstracts of Japan, JP 08 187873 A, vol. 1996, No. 11, (Nov. 29, 1996).

* cited by examiner

*Primary Examiner*—N. Le
*Assistant Examiner*—K. Feggins
(74) *Attorney, Agent, or Firm*—Fitzpatrick, Cella, Harper & Scinto

(57) ABSTRACT

Ink tank which enables accurate detection of existence/absence of liquid even if a storage containing liquid such as ink is stored under a severe environment, and a cartridge including the ink tank, as well as a printing apparatus utilizing the cartridge. A low surface energy processing agent including alkyl polysiloxane and alcohol is coated on prism 180 provided on the bottom portion of ink tank 7, thereby performing low surface energy processing on the prism 180.

12 Claims, 6 Drawing Sheets

INK TANK, CARTRIDGE INCLUDING THE INK TANK, AND PRINTING APPARATUS USING THE CARTRIDGE

BACKGROUND OF THE INVENTION

The present invention relates to an ink tank, a cartridge including the ink tank, and a printing apparatus using the cartridge, and more particularly, an ink tank supplying ink to a printhead which performs printing according to an ink-jet printing method, a cartridge including the ink tank, and a printing apparatus employing the cartridge.

Conventionally, as a method of detecting the amount of ink residue in an ink tank containing ink or detecting existence/absence of ink in the ink tank, optical detection of the amount of ink residue or ink existence/absence is known.

For instance, Japanese Patent Application Laid-Open (KOKAI) No. 8-112907 discloses an ink-jet printing apparatus which detects the amount of ink residue in an ink tank having a negative pressure generating material e.g. absorbent material, foaming material or the like, by transmitting light through a part of the transparent wall surface of the ink tank and detecting changes in optical reflectance in the boundary portion between the wall surface of the ink tank and the negative pressure generating material.

Furthermore, Japanese Patent Application Laid-Open (KOKAI) No. 7-218321 discloses an ink tank comprising an optical ink detection unit which is formed with a light-transmitting material made of the same material as the ink tank, and the boundary surface between ink and the optical ink detection unit has a predetermined angle with respect to an optical path. Still further, Japanese Patent Application Laid-Open (KOKAI) No. 9-29989 discloses an ink-jet printing apparatus capable of detecting existence/absence of ink and existence/absence of an ink tank by a single photosensor serving as both light-emission device and photoreceptor.

Besides the aforementioned apparatuses, Japanese Patent Application Laid-Open (KOKAI) No. 7-89090 discloses an apparatus for detecting existence or absence of liquid in a liquid container comprising: a negative-pressure-generating-material housing chamber which houses a negative pressure generating material and has a liquid supply opening and an air hole; and a liquid containing chamber which has a channel connected with the negative-pressure-generating-material housing chamber and forms a substantially enclosed space.

Herein, the conventional ink existence/absence detection mechanism utilizing a light-transmitting prism is explained with reference to FIG. 6. FIG. 6 shows a positional relation among a light-transmitting prism provided on the bottom surface of an ink tank, a light emission device which emits light on the prism, and a photoreceptor which receives the emitted light.

As shown in FIG. 6, a prism 1060 is integrally molded to the bottom portion 1061 of the ink tank. Light emitted externally by a light emission device 1062 from the bottom of the ink tank is incident on the prism 1060.

When the ink tank is sufficiently filled with ink, the incident light takes the optical path I→II' as shown in FIG. 6 and is absorbed by the ink, so that the light does not return to the photoreceptor 1063. On the other hand, when the ink is consumed and the ink tank contains no ink, the incident light is reflected by the oblique portion of the prism 1060 and takes the optical path I→II→III, then reaches the photoreceptor 1063 as shown in FIG. 6. In the foregoing manner, ink existence/absence is detected by whether or not the light emitted by the light emission device 1062 returns to the photoreceptor 1063.

Note that the light emission device 1062 and photoreceptor 1063 are provided in the main body of a printing apparatus.

The above-described ink existence/absence detection mechanism may be regarded as a rational method of realizing detection of an ink level or ink existence/absence in an ink tank at low cost.

Meanwhile, another configuration is also known for performing such optical ink residue detection. More specifically, water repellent processing is performed on a component provided in the optical path so as to avoid an ink droplet from being attached to the component. By this configuration, even when the amount of ink in the ink tank decreases, it is possible to avoid erroneous ink residue detection caused by the ink droplet attached to the surface of the component provided in the optical path.

For instance, Japanese Patent Application Laid-Open (KOKAI) No. 7-237300 discloses a construction utilizing silicone or Teflon resin as a water repellent agent in order to avoid ink droplet attachment to the side wall surface of the ink tank or light reflector, serving as a component provided in the optical path. In addition, Japanese Patent Application Laid-Open (KOKAI) No. 8-187873 discloses a technique of performing surface processing such as water repellent or oil repellent processing on the inner wall surface of an ink tank, which serves as a component provided in the optical path, instead of polishing the inner wall surface of the ink tank to reduce the surface roughness thereby enlarging the contact angle between ink and the ink tank inner wall surface.

However, recently, higher image quality and higher printing quality are required in ink-jet printing apparatuses, and the types of ink used in printing apparatuses are diversified. Inks used are, for instance, an aqueous pigment ink in which pigment serving as a colorant is dispersed in water with the use of a dispersant, or an aqueous pigment ink utilizing self-dispersing pigment capable of stable dispersion without using a dispersant by reforming the surface of the pigment, or a dispersing-type ink such as micro-emulsion ink or the like in which an oil-base dye is dispersed by emulsification.

Inventors of the present invention have used such ink, in which a colorant is dispersed, in the above- described conventional examples, and discovered that in the environment of a high temperature, even if there is no ink droplet attached to the inner portion of an ink tank, light emitted by a light emission device for ink residue detection and incident upon the ink tank does not always return to a photoreceptor.

As a result of careful study of the above problem by the inventors, the inventors have discovered that, particularly in the environment of a high temperature, dispersion of the colorant becomes unstable and the colorant adsorbs to the inner wall of the ink tank. When the colorant adsorbs to the inner wall of the ink tank, the light emitted by the light emission device for ink residue detection and incident upon the ink tank is absorbed by the colorant adsorbed to the inner wall of the ink tank.

Because of this, despite the fact that ink does not exist in the ink tank, determination is made that ink still exists in the ink tank.

SUMMARY OF THE INVENTION

The present invention is made in consideration of the result of the above study, and has an object to provide an ink tank which enables accurate detection of existence/absence of liquid even when using the type of ink in which a colorant is dispersed, a cartridge including the ink tank, and a printing apparatus employing the cartridge.

According to one aspect of the present invention, the foregoing object is attained by providing an ink tank, in which a part of a storage containing ink where a colorant is dispersed, is coated with a low surface energy processing agent including alkyl polysiloxane.

Herein, it is preferable that acid be included in the low surface energy processing agent.

Furthermore, it is preferable that the alkyl polysiloxane coated on the part of the storage be 1 to 15 $\mu$g per unit area (1 $mm^2$).

Furthermore, the storage comprises a prism having a first surface which receives light emitted by an external device, and a second surface which receives the light reflected by the first surface and changes an optical path of the light received such that the optical path of the light is headed to the external device, the prism formed with a light-transmitting material, provided on a bottom portion of the storage, and protruded from the bottom portion of the storage toward an interior of the storage, wherein the prism is coated with the low surface energy processing agent.

Still further, only the first surface and the second surface of the prism may be coated with the low surface energy processing agent.

According to another aspect of the present invention, the foregoing object is attained by providing an ink tank, in which a part of a light-transmitting wall surface which forms a storage containing ink where a colorant is dispersed, has lower surface energy than other portions of the wall surface.

Furthermore, it is preferable that a low surface energy processing agent including alkyl polysiloxane be coated on the part of the light-transmitting wall surface having low surface energy.

Furthermore, it is preferable that the ink tank comprises a prism having a shape of substantially polygonal prism where the part of the light-transmitting wall surface constitutes a plurality of reflection surfaces having a predetermined angle with respect to an optical path of light emitted from a light source located externally at a predetermined position, wherein a side surface of the prism is coated with the low surface energy processing agent including alkyl polysiloxane.

According to still another aspect of the present invention, the foregoing object is attained by providing an ink tank comprising: a storage containing ink where a colorant is dispersed; and a residual amount detector for optically detecting ink residue contained in the storage, wherein the residual amount detector is provided on a part of a wall surface which forms the storage, and the residual amount detector is coated with a low surface energy processing agent including alkyl polysiloxane and acid so as to have lower surface energy than other portions of the wall surface where the residual amount detector is not provided.

Herein, it is preferable that the storage comprises: a first chamber containing the ink only and forming a substantially enclosed space; a second chamber containing an absorbent which retains ink by absorbing ink and serves as a negative pressure generating material; and a channel where the first and second chambers are connected, wherein the first chamber includes the residual amount detector, and the second chamber includes an outlet for externally discharging liquid and an opening for introducing outside air.

According to still another aspect of the present invention, the foregoing object is attained by providing an ink tank, in which a part of a storage containing solution in which solvent includes insoluble or slightly soluble fine particles, is coated with a low surface energy processing agent including alkyl polysiloxane.

According to the aforementioned ink tank, since the surface of a part of the storage containing liquid in the ink tank is coated with a low surface energy processing agent, it is possible to create a surface energy difference in the inner wall of the liquid storage. By virtue of this, even in the case of utilizing an aqueous pigment ink in which pigment serving as a colorant is dispersed in water with the use of a dispersant, or an aqueous pigment ink utilizing self-dispersing pigment capable of stable dispersion without using a dispersant by reforming the surface of the pigment, or a dispersing-type ink such as micro-emulsion ink or the like in which an oil-base dye is dispersed by emulsification, attachment (adhesion) of the colorant to the surface-processed portion (having low surface energy) is suppressed, and the colorant is attached preferentially to other portions (having high surface energy) whose surface is not processed. As a result, it is possible to prevent attachment of the colorant to the surface processed portion (having low surface energy).

Accordingly, assuming that the surface processed portion is a prism provided in the optical path of optical ink residue detection, even when using the type of ink where a colorant is dispersed, existence or absence of liquid (ink) can be accurately detected.

According to still another aspect of the present invention, the foregoing object is attained by providing a cartridge including the ink tank having aforementioned configuration, the cartridge comprising: a printhead for discharging liquid contained in the ink tank; and a holder for holding the ink tank.

Herein, it is preferable that the ink tank be detachable from the holder.

Furthermore, it is preferable that the printhead be an ink-jet printhead which performs printing by discharging ink. In this case, the ink-jet printhead includes heat energy transducers for generating heat energy to be applied to the ink so that the printhead discharges ink by utilizing the heat energy.

According to still another aspect of the present invention, the foregoing object is attained by providing a printing apparatus for printing an image on a print medium by using the ink tank having aforementioned configuration, the printing apparatus comprising: a printhead for performing printing by discharging ink contained in the ink tank; optical means for emitting light to the residual amount detector and receiving reflection light from the residual amount detector; detection means for detecting a residual amount of liquid contained in the ink tank based on the optical means; and control means for controlling printing operation performed by the printhead based on the detection result obtained by the detection means.

Note that in the specification of the present invention, "weight" or "%" indicates a percentage by weight unless specified otherwise.

Moreover, the prism according to the present invention is formed with a light-transmitting material, and comprises a surface which constructs a part of an external wall surface of a liquid container such as an ink tank, and a plurality of reflection surfaces which are different from the aforementioned surface, and whose boundary surface with contents (e.g., ink) of the storage has a predetermined angle with respect to the optical path. The prism is structured such that the amount of light reflected by the reflection surfaces differs depending on existence or absence of the contents of the liquid storage. Therefore, the plurality of reflection surfaces are protruded toward the interior of the container. Note that instead of the plurality of reflection surfaces, a curved surface may be provided.

The present invention is particularly advantageous because, by coating the low surface energy processing agent not on the entire inner wall surface of the ink tank, but on the prism provided in an optical path of optical ink residue detection, it is possible to create a lower surface energy portion compared to other portions of the inner wall surface of the ink tank, which are in contact with ink. Therefore, even under a severe ink storage condition, a part of the composition of the liquid, e.g., colorant or the like, does not attach to remain on the prism surface. Accordingly, the prism is always kept in an excellent state for reflecting light, and therefore liquid existence/absence can be accurately detected.

Furthermore, by virtue of including acid in the low surface energy processing agent having alkyl polysiloxane, it is possible to increase the adsorbent of the alkyl polysiloxane which has adsorbed to the inner wall surface of the liquid container such as an ink tank.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention, and together with the description, serve to explain the principles of the invention.

DETAILED DESCRIPTION OF THE PREFERRED EMBODIMENTS

Preferred embodiments of the present invention will be described in detail in accordance with the accompanying drawings.

Figure 1:
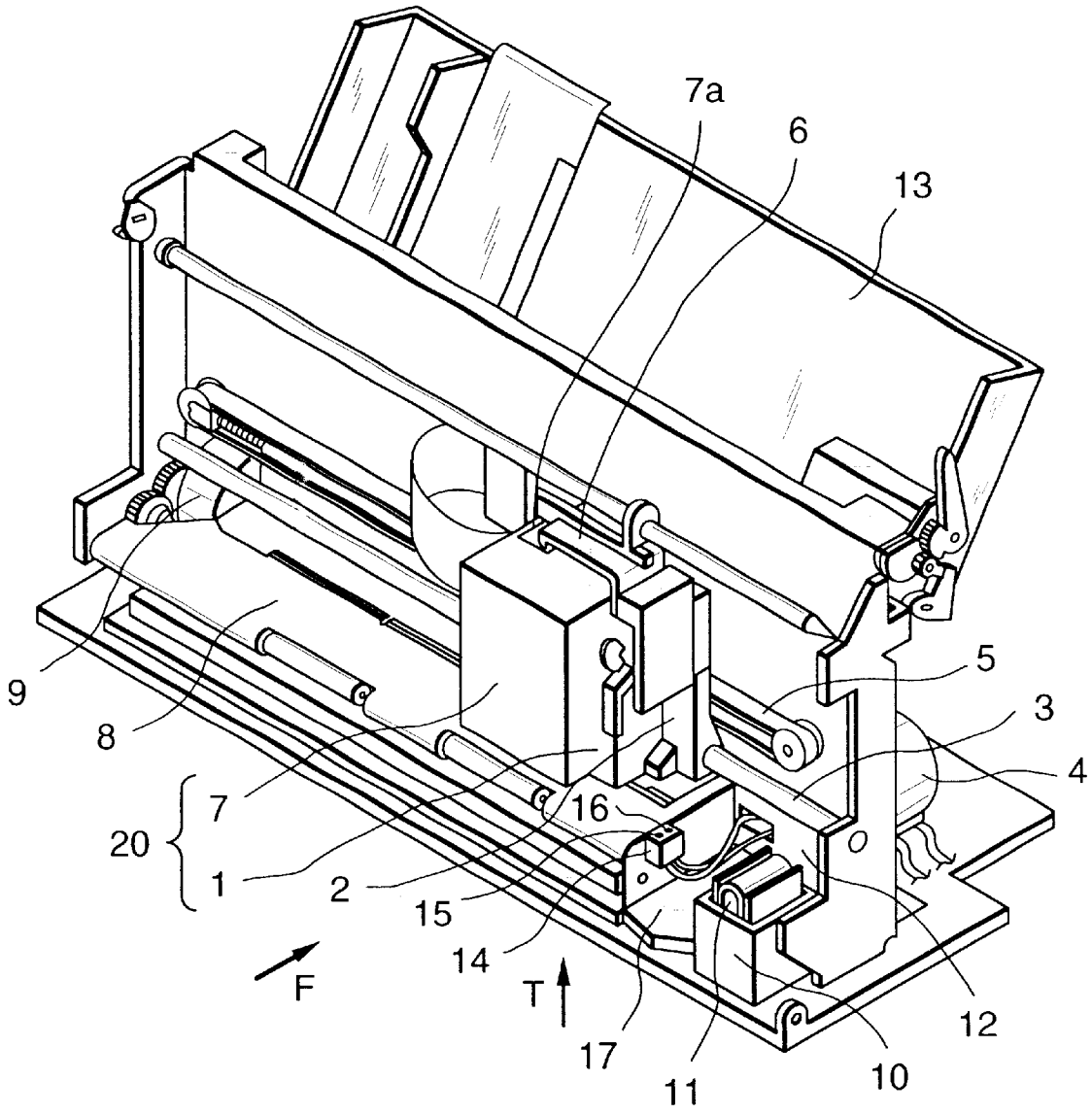
FIG. 1 is a perspective view showing a schematic construction of a printing apparatus, as a typical embodiment of the present invention, which includes a printhead for performing printing in accordance with an ink-jet printing method.

FIG. 1 is a perspective view showing a schematic construction of a printing apparatus, as a typical embodiment of the present invention, which includes a printhead for performing printing in accordance with an ink-jet printing method. In the present embodiment, a printhead 1 connected with an ink tank 7 which supplies ink thereto construct an ink cartridge 20 as shown in FIG. 1. Note, in the present embodiment, although the ink cartridge 20 is configured such that the printhead 1 and ink tank 7 are separable as will be described later, an ink cartridge where a printhead and ink tank are integrated as a unit may be used.

On the bottom surface of the ink tank 7, a prism for detecting existence/absence of ink is provided. The configuration thereof will be described later.

The printhead comprises means (e.g., electrothermal transducer or laser beam generator or the like) for generating heat energy as energy utilized upon execution of ink discharge, and employs a method which causes a change in state of ink by the heat energy, among ink-jet printing methods. According to this method, a high-density, high-precision printing operation can be attained.

Referring to FIG. 1, the printhead 1 is attached to a carriage 2 in the manner such that the printhead discharges ink downward in FIG. 1. While the carriage 2 moves along a guide 3, the printhead 1 discharges ink droplets to form an image on a print medium (not shown) e.g. print paper. Note that the lateral movement (reciprocal movement) of the carriage 2 is realized by rotation of a carriage motor 4 via a timing belt 5. The carriage 2 has an engagement latch 6 which engages with an engagement slot 7*a* of the ink tank, fixing the ink tank 7 to the carriage 2.

Upon printing for one scan by the printhead, the printing operation is suspended, a print medium positioned on a platen 8 is conveyed a predetermined amount by driving a feed motor 9, and image forming for the subsequent scan is performed by moving the carriage 2 along the guide 3.

On the right side of the main body of the printing apparatus, a recovery device 10 which performs recovery operation for maintaining a good ink discharge condition is provided. The recovery device 10 includes a cap 11 for capping the printhead 1, a wiper 12 for wiping the ink discharge surface of the printhead 1, and a suction pump (not shown) for sucking ink from the ink discharge nozzle of the printhead 1.

The driving force of the feed motor 9 for conveying a print medium, which is normally transmitted not only to the print medium conveyance mechanism, but also to an automatic sheet feeder (ASF) 13.

Moreover, on the side of the recovery device 10, an optical unit 14, consisting of an infrared LED (light emission device) 15 and phototransistor (photoreceptor) 16, is provided for detecting existence/absence of ink and existence/absence of an ink tank. These light emission device 15 and photoreceptor 16 are arrayed in the conveyance direction of a print medium (direction indicated by the arrow F). The optical unit 14 is attached to a chassis 17 of the main body of the printing apparatus. Upon attaching the ink cartridge 20 to the carriage 2, if the carriage 2 moves to the right from the position shown in FIG. 1, the ink cartridge 20 comes to the position above the optical unit 14. In this position, it is possible to detect the ink existence or absence from the bottom surface of the ink tank 7 by using the optical unit 14 (details will be described later).

Next, the configuration for executing print control of the above-described apparatus will be described.

Figure 2:
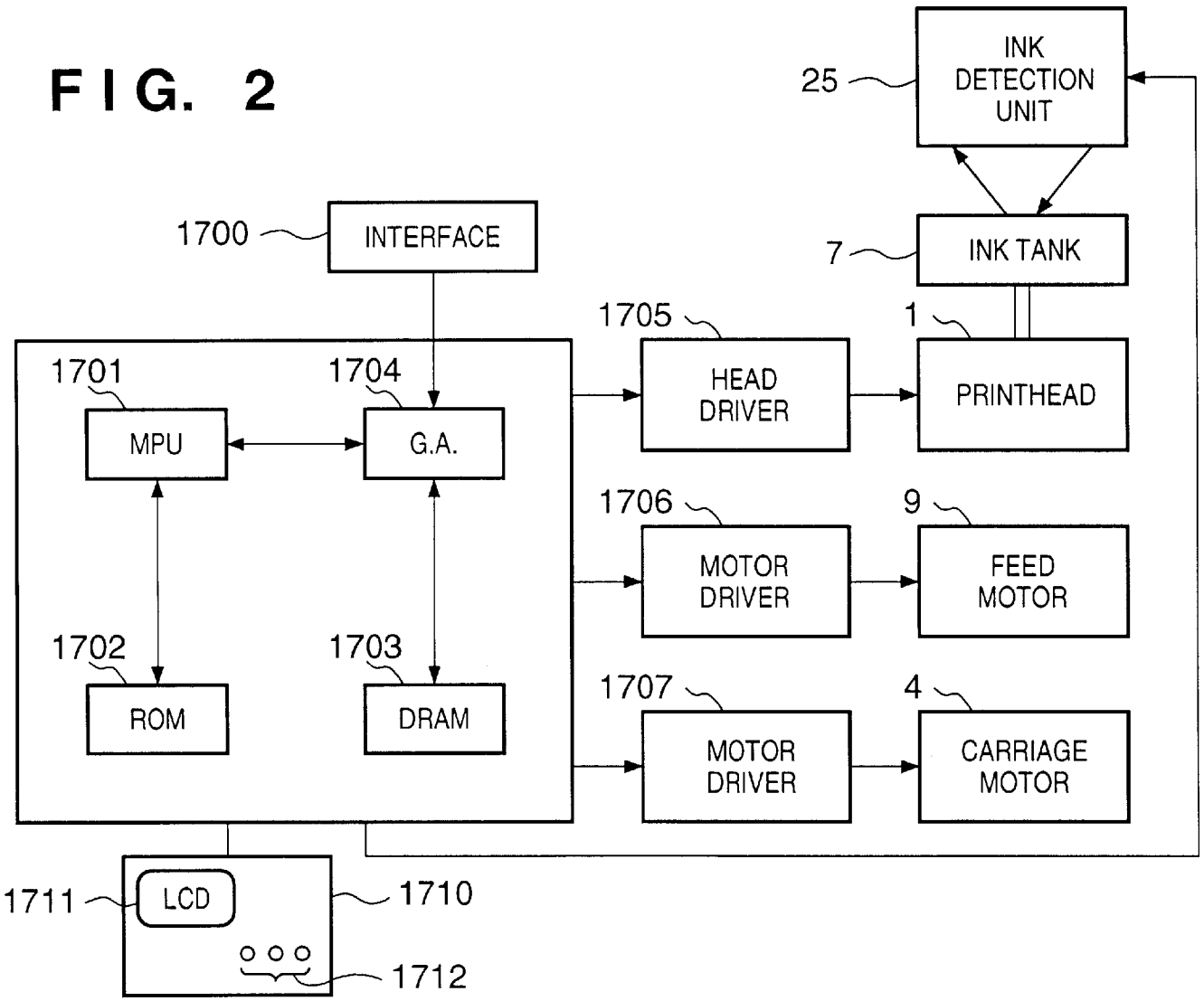
FIG. 2 is a block diagram showing a structure of a control circuit of the printing apparatus.

FIG. 2 is a block diagram showing the structure of a control circuit of the printing apparatus. In FIG. 2, reference numeral 1700 denotes an interface for inputting a print signal; 1701, an MPU; 1702, a ROM for storing control programs to be executed by the MPU 1701; and 1703, a DRAM for storing various data (aforementioned print signal, print data supplied to the printhead 1 and so on). Reference numeral 1704 denotes a gate array (G.A.) which controls supplying print data to the printhead 1, and also controls data transfer among the interface 1700, MPU 1701 and RAM 1703. Reference numeral 1705 denotes a head driver for driving the printhead 1; 1706 and 1707, motor drivers for driving the feed motor 9 and carriage motor 4 respectively.

The operation of the foregoing control structure will now be described. When the interface 1700 receives a print signal, the print signal is converted to print data for printing in between the gate array 1704 and the MPU 1701. Then, as the motor drivers 1706 and 1707 are driven, the printhead 1 is driven in accordance with the print data transmitted by the head driver 1705, performing printing.

Note that reference numeral 1710 denotes a display portion comprising an LCD 1711 which displays various messages related to a condition of printing operation or the printing apparatus, and an LED lamp 1712 including various colors for informing the conditions of printing operation or the printing apparatus.

Moreover, the MPU 1701 controls the operation of an ink detection unit 25 which detects ink existence/absence in the ink tank 7. The ink detection unit 25 is described below in detail.

Figure 3B:
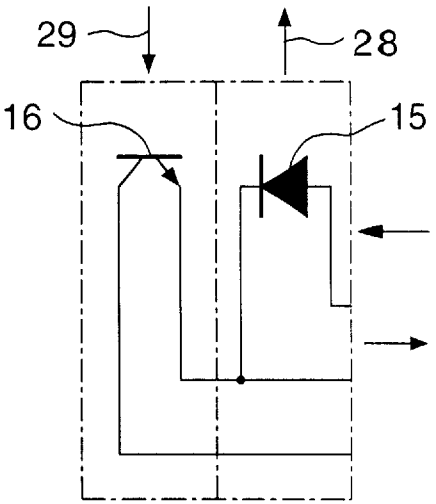
FIGS. 3A and 3B are block diagrams showing detailed configuration of an ink detection unit 25.
Figure 3A:
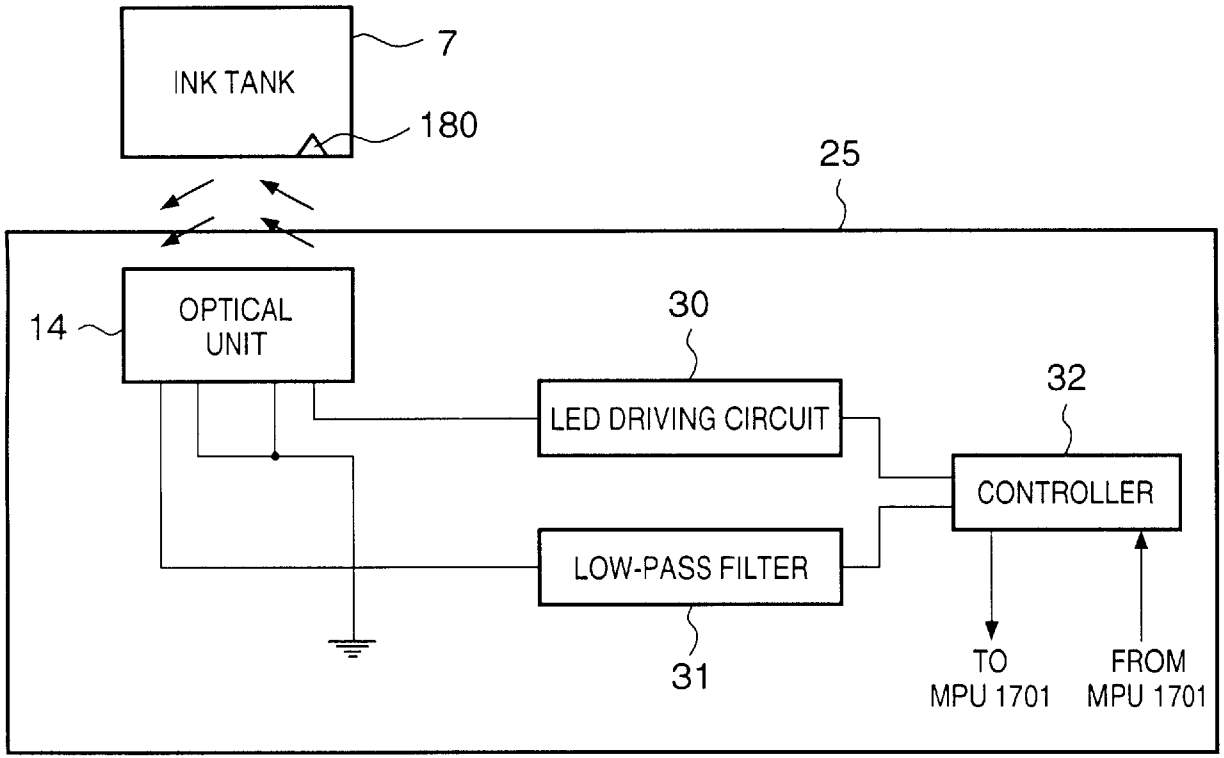

FIGS. 3A and 3B are block diagrams showing detailed configuration of the ink detection unit 25.

In the configuration shown in FIG. 3A, the controller 32 outputs a pulse signal having a predetermined duty ratio (DUTY) (%) to an LED driving circuit 30 based on a control signal sent by the MPU 1701, and drives the light emission device 15 which constructs a part of the optical unit 14 in accordance with the duty ratio so as to emit infrared light upon the bottom portion of the ink tank 7.

The infrared light is reflected upon the optical prism 180 (hereinafter referred to as the prism) provided on the bottom portion of the ink tank 7 and returned to the photoreceptor 16 which constructs the rest of the optical unit 14. The photoreceptor 16, i.e. a phototransistor, converts the received light into an electrical signal and outputs the electrical signal to a low-pass filter (LPF) 31. The low-pass filter (LPF) 31 transmits only the signal having a low frequency component of the received electrical signal to the controller 32, eliminating high frequency noise. The controller 32 performs A/D conversion on the signal transmitted by the low-pass filter (LPF) 31, converting it into a digital signal. Then, the converted digital signal is transferred to the MPU 1701.

Note that the light emission device 15 is an LED emitting infrared light 28, and the photoreceptor 16 is a phototransistor for receiving infrared light 29 and outputting an electrical signal in accordance with the intensity of the received light, as shown in FIG. 3B. These LED and phototransistor are arranged along the conveyance direction of a print medium as shown in FIG. 1.

Next, an overall configuration of the ink tank preferably applicable to the present embodiment will be described with reference to FIGS. 4 and 5.

Figure 4B:
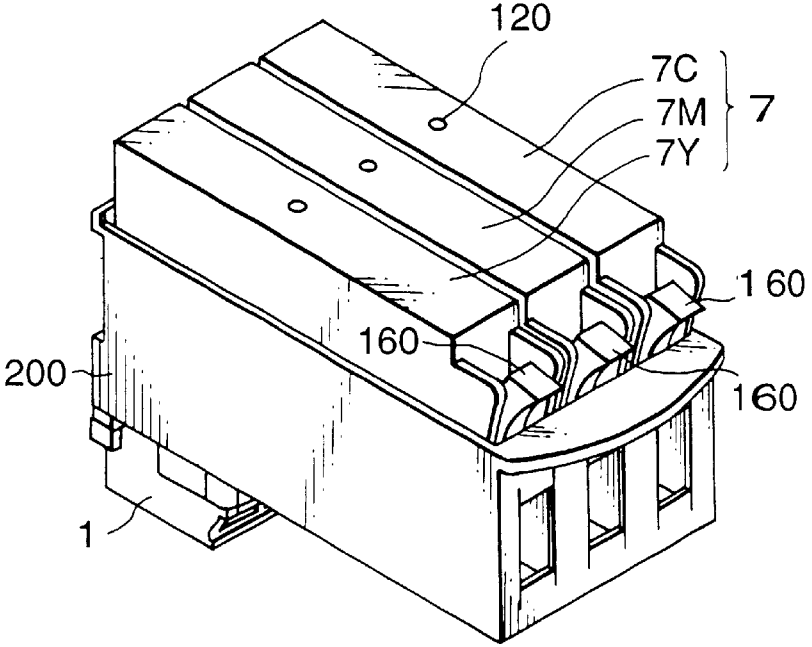
FIGS. 4A and 4B are perspective views showing an external appearance of a head holder 200 holding an ink tank 7 and printhead 1.
Figure 4A:
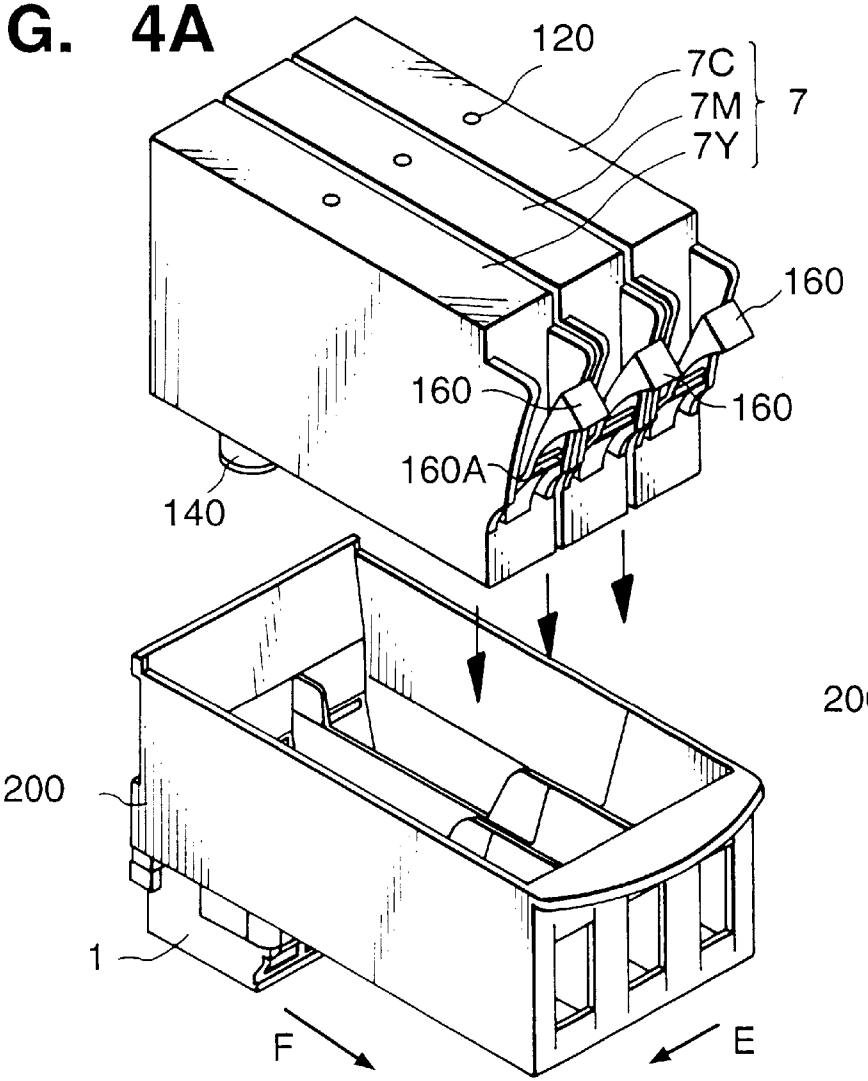

FIGS. 4A and 4B are perspective views showing an external appearance of a head holder 200 holding the ink tank 7 and the printhead 1. FIG. 4A shows the state where the ink tank 7 is detached from the head holder 200, while FIG. 4B shows the state where the ink tank 7 is held by the head holder 200. FIG. 5 is a sectional side view showing an internal structure of the ink tank 7.

The ink tank 7 according to the present embodiment has a shape approximate of a rectangular parallelepiped, and has an air hole 120 on the upper wall 7U, which connects with the internal portion of the ink tank 7.

On the bottom wall 7B of the ink tank 7, an ink supply pipe 140 having an ink supply opening is protruded in the pipe-like form. In the shipping stage, the air hole 120 is sealed with a film or the like, and the ink supply pipe 140 is sealed with a cap, which is an ink supply opening sealing material.

Reference numeral 160 denotes a resilient lever formed integrally on the outer portion of the ink tank 7, and a latch 160A is provided in the middle of the lever.

Reference numeral 200 denotes a head holder integrating a printhead, where the aforementioned ink tank 7 is to be attached. In the present embodiment, ink tank 7 including three containers (7C, 7M and 7Y), each having e.g. cyan, magenta or yellow ink, are held in the head holder 200. On the bottom of the head holder 200, the printhead 1 which discharges each of the color ink is integrally formed. Note that an ink tank containing black (Bk) ink only may be attached to the head holder to construct a printhead for monochrome printing. A window is provided on the bottom of the head holder 200 so that an ink existence/absence detection portion, which will be described later, can detect whether or not there is residual ink, in cooperation with the optical unit 14 and ink detection unit 25.

The printhead 1 is formed such that the plural discharge orifices of the printhead face downward (hereinafter the surface of the printhead where the plural discharge orifices are formed will be referred to as discharge-orifice surface).

From the state shown in FIG. 4A, the ink tank 7 is pressed into the head holder 200 such that the ink supply pipe 140 is engaged with an ink supply pipe receptor (not shown) provided in the printhead 1 and an ink passage pipe of the printhead 1 is inserted into the ink supply pipe 140. As a result, the latch 160A of the lever 160 is engaged with a projection (not shown) formed in a predetermined portion of the head holder 200, and the ink tank 7 is properly inserted in the head holder 200 as shown in FIG. 4B. The head holder 200 integrating the ink tank 7 is attached to e.g., the carriage 2 of the printing apparatus shown in FIG. 1, and become ready for printing. In this state, there is a liquid level difference (H) between the level of liquid on the bottom portion of the ink tank 7 and the level of liquid on the discharge-orifice surface of the printhead 1.

Next, the internal structure of the ink tank 7 will be described with reference to FIG. 5.

The ink tank 7 according to the present embodiment lets air in through the air hole 120 provided on the ceiling portion of the ink tank, and the bottom portion of the ink tank 7 is connected to the ink supply opening. Inside the ink tank 7, a negative-pressure-generating-material housing chamber 340 including an absorbent material 320 serving as a negative pressure generating material, and a substantial-closed liquid storage 360 containing liquid ink are separated by a partition wall 380. The negative-pressure-generating-material housing chamber 340 and liquid storage 360 are connected only through a channel 400 of the partition wall 380 formed near the bottom portion of the ink tank 7.

On the upper wall 7U of the ink tank 7 which forms the negative-pressure-generating-material housing chamber 340, plural ribs 420 projected into the ink tank 7 are formed, and the plural ribs are in contact with the absorbent material 320 housed in the negative-pressure-generating-material housing chamber 340 in the compressed form. Between the upper wall 7U and the top surface of the absorbent material 320, an air buffer room 440 is formed. The absorbent material 320 is formed with heat-compressed urethane foam, and housed in the negative-pressure-generating-material housing chamber 340 in the compressed form so as to produce a predetermined capillarity which will be described later. An absolute value of the pore size of the absorbent material 320 for producing the predetermined capillarity differs depending on the type of the ink used, dimension of the ink tank 7, position of the discharge-orifice surface of the printhead 1 (liquid level difference H) and so on.

In the ink supply pipe 140 forming the ink supply opening 140A, a disc-shape or cylindrical-shape pressured solid body 460 is provided. The pressured solid body 460 is formed with a felt made of e.g. polypropylene, and is not deformed easily by external force. In the state shown in FIG. 4A where the ink tank is not inserted in the head holder 200, the pressured solid body 460 is pushed into the absorbent material 320 so as to partially compress the absorbent material 320. Therefore, at the upper end portion of the ink supply pipe 140, a flange is formed around the pressured solid body 460.

In the ink tank, configured with the negative-pressure-generating-material housing chamber which houses a negative-pressure material and includes the liquid supply opening and air hole, and the liquid storage which forms substantial enclosed space and has a passage connected to the negative-pressure-generating-material housing chamber, when ink absorbed by the absorbent material 320 is consumed by the printhead 1, ink is supplied to the absorbent material 320 in the negative-pressure-generating-material housing chamber 340 from the liquid storage 360 through the channel 400 of the partition wall 380. At this time, although the pressure inside the liquid storage 360 is reduced, air from the air hole 120, coming through the negative-pressure-generating-material housing chamber 340, is supplied to the liquid storage 360 through the channel 400 provided on the partition wall 380, and the reduced pressure in the liquid storage 360 is compensated. Therefore, even if ink is consumed by the printhead 1, ink is provided to the absorbent material 320 in accordance with the consumed amount, enabling the absorbent material 320 to keep a constant amount of ink and maintain a substantially constant negative pressure to the printhead 1. Accordingly, ink supplied to the printhead is kept stable. As the ink absorbed by the absorbent material 320 is consumed, ink in the liquid storage 360 is consumed.

Accordingly, by virtue of providing the liquid storage 360 of the ink tank with the prism 180 which becomes a part of the ink existence/absence detection mechanism to inform a user that ink in the liquid storage 360 has been consumed, thus letting the user exchange the ink tank, the printing apparatus can be used without concern of ink shortage.

According to the present embodiments, the prism 180 serves as the above-described ink existence/absence detection portion.

The prism 180 is a triangular prism having a shape of an isosceles triangle whose apical angle is 90°. Therefore, if the length (a) of the base of the isosceles triangle and the length (b) of the prism in the direction perpendicular to the drawing sheet of FIG. 5 are known, the area (S) of the prism's oblique planes exposed inside the ink tank 7 is obtained by $(\sqrt{2})\times a\times b$.

Next, description will be provided on the processing of improving water repellency to prevent attachment of a colorant to the prism 180, employed in the printing apparatus having the above-described configuration for detecting ink existence/absence. This processing is performed to lower the surface energy on the prism surface relatively to other areas of the ink tank, and will be referred to as low surface energy processing hereinafter.

A processing agent employed in the low surface energy processing according to the present embodiment has a composition specified in the embodiments 1 and 2 which will be described later. Although each of the embodiments 1 and 2 assumes that the density of alkyl polysiloxane is 4 weight %, the alkyl polysiloxane content in the low surface energy processing agent is in the range of 1 to 20 weight %, more preferably, 2 to 8 weight %.

The reason is that, although it depends upon the coated amount of the low surface energy processing agent, if the alkyl polysiloxane content is excessive, alkyl polysiloxane which does not adsorb to the surface of the prism 180 may elute in the ink and cause deterioration of ink discharge capability, whereas if the alkyl polysiloxane content is small, the surface of the prism 180 is not sufficiently processed to achieve low surface energy processing and the expected effect cannot be attained.

Furthermore, although 2-propanol and 2-methyl-2-propanol are employed as alcohol to serve as a solvent of alkyl polysiloxane, the present invention is not limited to this, but may employ volatile alcohol or water soluble volatile organic solvent.

Moreover, although the embodiment 1 to be described below employs benzenesulfonic acid as an acid substance, a strongly acidic substance, e.g., sulfuric acid, nitric acid, hydrochloric acid, aromatic sulfonic acid, aliphatic sulfonic acid or the like, may be used.

The aforementioned low surface energy processing is performed by applying a droplet (about 3 mg) of the low surface energy processing agent having the foregoing composition onto the vertex of the prism 180 with a needle (injection needle) having a diameter of 26 G, and naturally drying it after the application. Note that the prism 180 used in the present embodiment is a triangular prism having a shape of an isosceles triangle whose apical angle is 90°, wherein the length (a) of the base of the isosceles triangle is 7 mm and the length (b) of the prism in the direction perpendicular to the drawing sheet of FIG. 5 is 2.6 mm.

By performing the low surface energy processing, since the area of the prism's oblique planes exposed to the interior of the ink tank 7 is 25.7 $mm^2$, 4.7 $\mu g/mm^2$ of alkyl polysiloxane per unit area (1 $mm^2$) is coated on the prism.

Herein, as mentioned above, if the low surface energy processing agent is coated excessively, the processing agent may not completely be adsorbed to the prism surface, whereas if the coated amount of the low surface energy processing agent is too small, sufficient low surface energy processing may not be performed. Therefore, it is preferable that the amount of alkyl polysiloxane coated in the portion (in this case, prism) subjected to the low surface energy processing with the low surface energy processing agent be in the range of 1 to 15 $\mu g/mm^2$.

By the above-described method, low surface energy processing using the low surface energy processing agent having alkyl polysiloxane is performed on the surface of the prism in the liquid container according to the present invention, which is provided in the optical path of optical ink existence/absence detection. Therefore, the surface energy on the prism surface becomes relatively lower than other areas of the inner wall of the storage. The liquid container, on which such processing has been performed, is used as an ink tank for which ink existence/absence detection is performed.

[Embodiments]

In order to verify the effect of the low surface energy processing, the following comparative experiment was conducted.

In the experiment, aqueous pigment ink having the following composition was used.

Composition of aqueous pigment ink surface functionalized carbon black dispersion (product name: Microjet C-type CW1, Orient Chemical Co.) . . . 5 weight % diethylene glycol (water soluble organic solvent) . . . 5 weight % glycerin (water soluble organic solvent) . . . 7 weight % thiodiethyleneglycol (water soluble organic solvent) . . . 7 weight %

Acetylenol EH (trade name: product of Kawaken Fine Chemicals Co., Ltd.) (surface active agent) . . . 0.1 weight % potassium sulfate (additive) . . . 0.3 weight % water . . . remainder weight %

The pigment employed in this embodiment is of a self-dispersing type, which does not use a dispersant and thus clogging in an ink discharge nozzle of a printhead caused by the resin forming the dispersant is improved.

Next, the prism of an ink tank such as that shown in FIG. 5 was subjected to the low surface energy processing which will be described below as embodiments and the ink tank was filled with aqueous pigment ink having the aforementioned composition. Then, the ink tank was stored for a month under the environment where temperature was 60° C., then ink was extracted from the ink tank, and ink residue detection was performed by using the printing apparatus having the above-described construction.

Herein, an ink tank, upon which ink residue detection was performed according to the above-described procedure with the use of the processing agent of the following embodiment 1, will be referred to as an experimental sample 1, and an ink tank, upon which the detection was similarly performed with the use of the processing agent of the following embodiment 2, will be referred to as an experimental sample 2.

(Embodiment 1)

Composition of low surface energy processing agent A

| | |
|---|---|
| alkyl polysiloxane | 4 weight % |
| 2-propanol (alcohol) | 45.7 weight % |
| 2-methy1-2-propanol (alcohol) | 50 weight % |
| benzenesulfonic acid (acid) | 0.3 weight % |

(Embodiment 2)

Composition of low surface energy processing agent B

| | |
|---|---|
| alkyl polysiloxane | 4 weight % |
| 2-propanol (alcohol) | 46 weight % |
| 2-methyl-2-propanol (alcohol) | 50 weight % |

The processing agent of each embodiment was coated on the prism with a needle, as described above, for a desired amount, and naturally dried. In each embodiment, the amount of alkyl polysiloxane coated on the prism was in the range of 1 to 15 $\mu$g per unit area (1 $mm^2$).

For the purpose of comparison, the following two ink tanks were prepared: (1) an ink tank, whose prism was not processed by low surface energy processing, but was filled with the aqueous pigment ink having the aforementioned composition and stored under the same environment (temperature of 60° C. for a month); and (2) an ink tank, whose entire inner wall surface was coated with the low surface energy processing agent A of the foregoing embodiment 1, which was then filled with the aqueous pigment ink having the aforementioned composition, and stored under the same environment (temperature of 60° C. for a month). After the storage period, ink was extracted from each of the above ink tanks, and the ink residue detection was similarly performed using the printing apparatus having the above-described construction. Herein, the former ink tank (1) on which ink residue detection was performed according to the aforementioned procedure will be referred to as a comparative reference sample 1, and the latter ink tank (2) will be referred to as a comparative reference sample 2.

As a result, on the prism of the experimental sample 1, there was no colorant attachment found even after the month of storage under the environment where temperature was 60° C., thus ink residue detection was effectively performed. On the other hand, in the comparative reference samples 1 and 2, the colorant was attached obviously to the prism after the month of storage under the environment where temperature was 60° C., and ink residue detection was not effectively performed (in other words, despite the empty ink tank, it was determined that ink still exists because of the colorant attached to the prism).

On the contrary, although colorant attachment was found in the experimental sample 2, in a case where the same low surface energy processing agent B as in the experimental sample 2 was applied and the period of ink storage was reduced (e.g., a couple of days or less), ink attachment was not found. From the foregoing comparative experiment, it was verified that, although acid is dispensable as the component of low surface energy processing agent, including acid as the component of the low surface energy processing agent having alkyl polysiloxane can prevent alkyl polysiloxane, adsorbed to the liquid storage, from falling off the container and eluting in the ink. In other words, an effect of improved adsorption is attained.

Therefore, according to the above-described embodiments, by coating the low surface energy processing agent not on the entire inner wall surface of the ink tank, but on a prism provided in the optical path of the optical ink residue detection, it is possible to create a lower surface energy portion compared to other portions of the inner wall of the ink tank, which are in contact with ink. Therefore, even under a severe ink storage condition, the colorant does not attach to the prism, and accurate ink existence/absence detection can be performed.

Note that in the foregoing embodiments, although descriptions have been provided assuming that a droplet discharged from a printhead is ink and that the liquid contained in the ink tank is ink, the contents in the ink tank is not limited to ink. For example, the ink tank may contain dispersing type solution such as processing liquid or the like to be discharged on a print medium for enhancing fixation of a printed image, water-proofing a printed image, or improving image quality.

Furthermore, although the foregoing embodiments have provided an example of performing water repellent processing on a prism used for ink residue detection, the present embodiment may preferably employ the specific structure of a prism and sequence of ink existence/absence detection which are disclosed in Japanese Patent Application Laid-Open No. 10-323993 filed by the same patent applicant as the present invention. In addition, the subject upon which the low surface energy processing agent is coated is not limited to the aforementioned prism, but the ink storage portion of an ink tank which merely contains ink may be formed with a light-transmitting material and a part of the storage portion may be coated with the above-described low surface energy processing agent. Furthermore, also in the case of performing ink residue detection of an ink tank as disclosed in Japanese Patent Application Laid-Open No. 8-11290, in which the residual amount in an ink tank having a negative pressure generating material such as an absorbent material is detected by transmitting light through a part of the transparent wall of the ink tank and determining changes in optical reflectance in the boundary portion between the wall surface of the ink tank and the negative pressure generating material, the above-described low surface energy processing may be performed on the portion of the ink tank wall surface, through which light is transmitted. In this case, even if the aforementioned aqueous pigment ink is used, the residual amount can be visually confirmed with ease.

Figure 6:
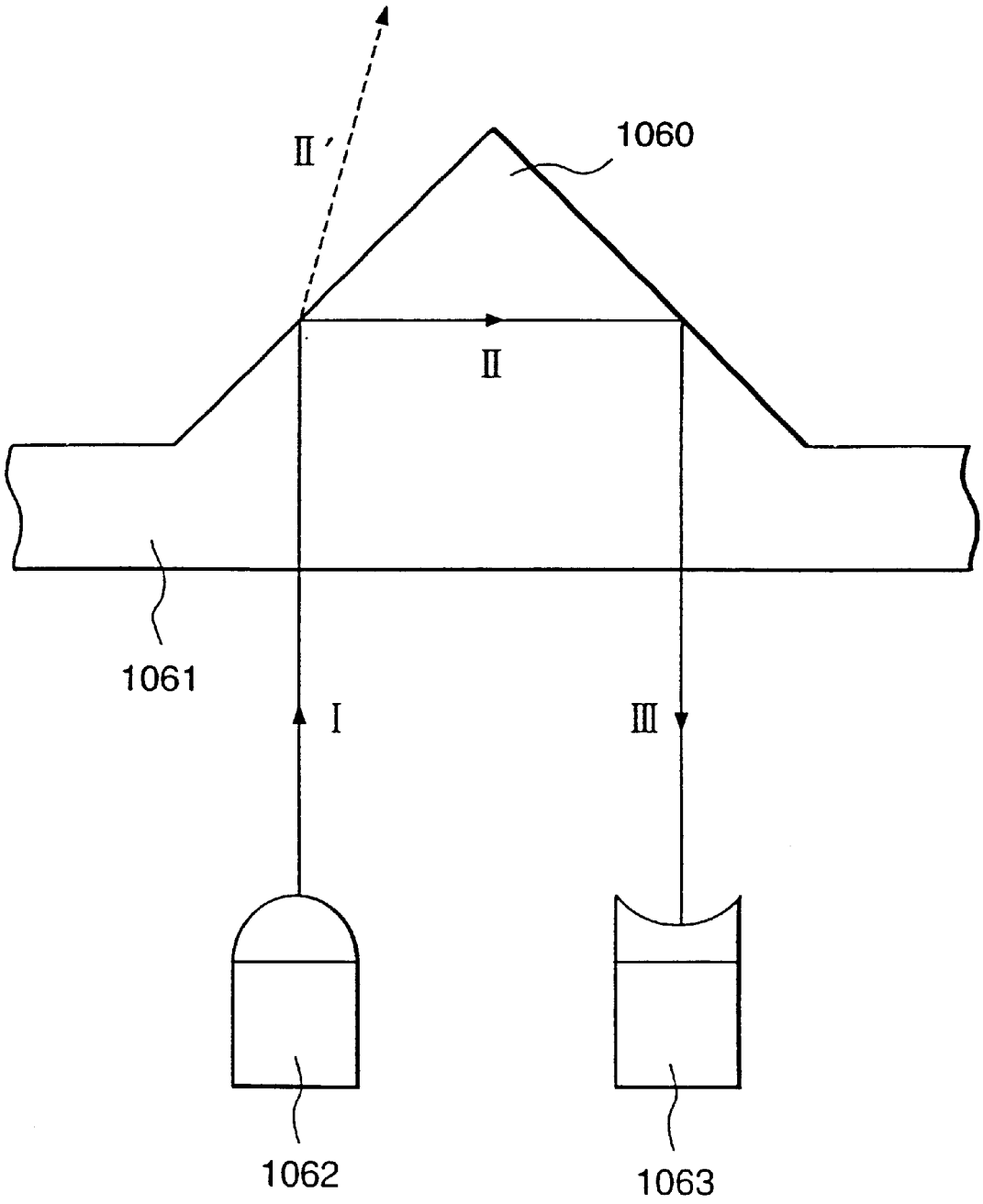
FIG. 6 PRIOR ART
FIG. 6 shows a positional relation among a conventional light-transmitting prism provided on the bottom surface of an ink tank, a light emission device which emits light on the prism, and a photoreceptor which receives the emitted light.

As mentioned above, the prism shown in FIG. 6 is formed with a light-transmitting material, and comprises a surface which constructs a part of the external wall surface of the liquid container such as an ink tank, and a plurality of reflection surfaces which are different from the aforementioned surface, and whose boundary surface with contents (e.g., ink) of the container has a predetermined angle with respect to the optical path. The prism is structured such that the amount of light reflected by the reflection surfaces differs depending on existence or absence of the contents of the container. By virtue of using such prism having the foregoing configuration, ink existence/absence can be detected by utilizing the difference in a refractive index in the ink tank, which depends upon the existence/absence of substance on the reflection surfaces.

Figure 5:
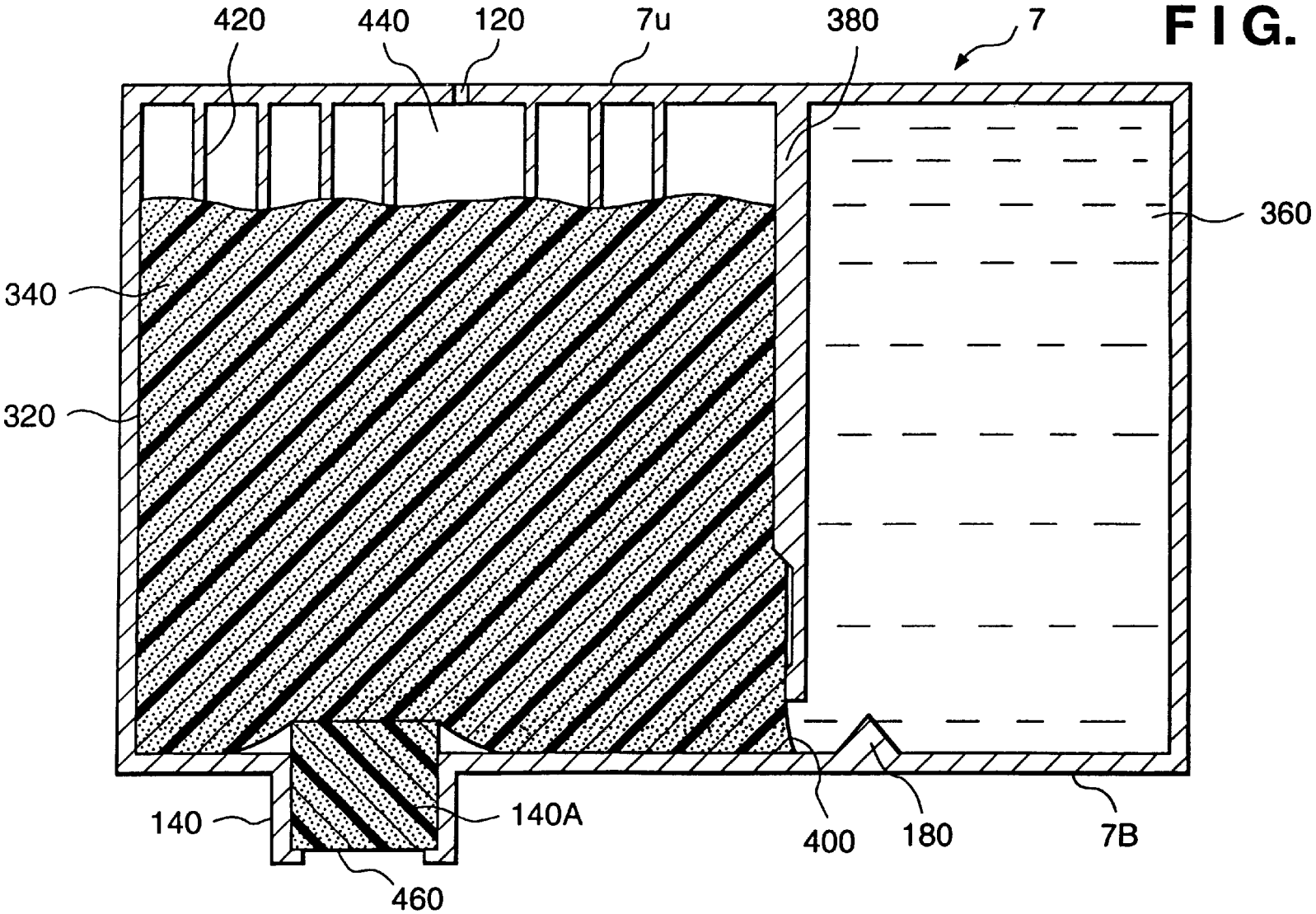
FIG. 5 is a sectional side view showing an internal structure of the ink tank 7.

Therefore, applying the present invention to the above-described prism is particularly advantageous because, in the case of using ink in which colorant such as aqueous pigment ink is dispersed, an ink droplet does not attach to the prism provided on the bottom of the ink tank shown in FIG. 5 when there is no ink in the ink tank. Furthermore, even if the dispersion of the colorant is unstable under the high-temperature environment, the colorant does not attach to the prism.

Furthermore, since the printing apparatus described in the foregoing embodiments is capable of printing at high density and high speed, the apparatus may be used as output means of a data processing system, such as a printer serving as an output terminal such as a copy machine, facsimile, electronic typewriter, word processor, work station, or as a handy or portable printer which accompanies a personal computer, optical disk apparatus, video apparatus or the like. In this case, the printing apparatus is realized in the form adaptive to the unique function and usage configuration of each apparatus.

Therefore, the application range of the ink tank as the liquid container according to the present invention is not limited to a printing apparatus, but may be extended to various apparatuses such as a facsimile apparatus or a copy machine or the like. Furthermore, the present invention can be applied to a system constituted by a plurality of devices (e.g., host computer, interface, reader, printer) or to an apparatus comprising a single device (e.g., copy machine, facsimile).

The present invention is not limited to the above embodiments and various changes and modifications can be made within the spirit and scope of the present invention. Therefore, to apprise the public of the scope of the present invention, the following claims are made.

What is claimed is:

1. An ink tank, comprising a storage portion containing ink in which a colorant is dispersed, wherein only a part of said storage portion is coated with a low surface energy processing agent including alkyl polysiloxane, wherein said storage portion comprises a prism having a first surface which receives light emitted by an external device, and a second surface which receives the light reflected by said first surface and changes an optical path of the light received such that the optical path of the light is directed to the external device, said prism being formed from a light-transmitting material, being provided on a bottom portion of said storage portion, and being protruded from said bottom portion of said storage portion toward an interior of said storage portion, wherein said prism is coated with said low surface energy processing agent, and wherein said prism is constructed as a member for detecting ink residue of said ink tank.

2. The ink tank according to claim 1, wherein the low surface energy processing agent includes acid.

3. The ink tank according to claim 1, wherein said alkyl polysiloxane coated on said part of said storage portion is 1 to 15 $\mu$g per mm$^2$.

4. The ink tank according to claim 1, wherein low surface energy processing is performed only on said first and second surfaces of said prism.

5. An ink tank comprising a storage portion containing ink in which a colorant is dispersed, and a light-transmitting wall surface for forming said storage portion, said light-transmitting wall surface including a surface of a prism having a shape of a substantially polygonal prism, wherein said prism comprises a plurality of reflection surfaces having predetermined angles with respect to an optical path of light emitted from a light source located externally to said storage portion at a predetermined position, and at least one of said reflection surfaces is coated with a low surface energy processing agent including alkyl polysiloxane so as to have a surface energy lower than that of other portions of said wall surface, and wherein said prism is constructed as a member for detecting ink.

6. An ink tank comprising:

a storage portion containing ink in which a colorant is dispersed; and a residual amount detector, which optically detects ink residue contained in said storage portion, wherein said storage portion comprises a first chamber containing the ink only and forming a substantially enclosed space, a second chamber containing an absorbent which retains ink by absorbing ink and serves as a negative pressure generating material, and a channel connecting said first and second chambers, wherein said first chamber includes said residual amount detector, and said second chamber includes an outlet for externally discharging liquid and an opening for externally introducing air, and wherein said residual amount detector is provided on a portion of a wall surface which forms said storage portion, and said residual amount detector comprises a prism having a shape of a substantially polygonal prism and comprising a plurality of reflection surfaces having predetermined angles with respect to an optical path of light emitted from a light source located externally to said storage portion at a predetermined position, and at least one of said reflection surfaces is coated with a low surface energy processing agent including alkyl polysiloxane and acid so as to have a surface energy lower than that of other portions of said wall surface.

7. An ink tank, comprising a storage portion containing ink in which a colorant is dispersed, wherein only a part of said storage portion, containing solution in which solvent includes insoluble or slightly soluble fine particles, is coated with a low surface energy processing agent including alkyl polysiloxane, wherein said storage portion comprises a prism having a first surface which receives light emitted by an external device, and a second surface which receives the light reflected by said first surface and changes an optical path of the light received such that the optical path of the light is directed to the external device, said prism being formed from a light-transmitting material, being provided on a bottom portion of said storage portion, and being protruded from said bottom portion of said storage portion toward an interior of said storage portion, wherein said prism is coated with said low surface energy processing agent, and wherein said prism is constructed as a member for detecting ink residue of said ink tank.

8. A printing apparatus for printing an image on a print medium by using the ink tank according to claim 6, said printing apparatus comprising:

a printhead for performing printing by discharging ink contained in said ink tank;

optical means for emitting light to said residual amount detector and receiving light reflected from said residual amount detector;

detection means for detecting a residual amount of liquid contained in said ink tank based on the reflected light received by said optical means; and control means for controlling printing operation performed by said printhead based on a detection result obtained by said detection means.

9. A cartridge including said ink tank according to any one of claims 1–3, 4, 5, 6 or 7, said cartridge comprising:

a printhead for discharging liquid contained in said ink tank; and a holder for holding said ink tank.

10. The cartridge according to claim 9, wherein said ink tank is detachable from said holder.

11. The: cartridge according to claim 9, wherein said printhead is an ink-jet printhead which performs printing by discharging ink.

12. The cartridge according to claim 11, wherein said ink-jet printhead includes heat energy transducers for generating heat energy to be applied to the ink so that said printhead discharges ink by utilizing the heat energy.

* * * * *

UNITED STATES PATENT AND TRADEMARK OFFICE

CERTIFICATE OF CORRECTION

PATENT NO. : 6,540,314 B1
DATED : April 1, 2003
INVENTOR(S) : Mikio Sanada et al.

It is certified that error appears in the above-identified patent and that said Letters Patent is hereby corrected as shown below:

Title page,
Item [56], References Cited, FOREIGN PATENT DOCUMENTS,
"KR 0000 492 3/1988" should be deleted.

Column 2,
Line 45, "above- described" should read -- above-described --.

Column 16,
Line 15, "claims 1-3, 4, 5, 6 or 7," should read -- claims 1-7, --; and
Line 21, "The:" should read -- The --.

Signed and Sealed this

Ninth Day of December, 2003

JAMES E. ROGAN
*Director of the United States Patent and Trademark Office*